US009886906B2

(12) United States Patent
Tan et al.

(10) Patent No.: US 9,886,906 B2
(45) Date of Patent: Feb. 6, 2018

(54) PIXEL CIRCUIT, PIXEL CIRCUIT DRIVING METHOD AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Wen Tan, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 196 days.

(21) Appl. No.: 14/646,324

(22) PCT Filed: Sep. 30, 2014

(86) PCT No.: PCT/CN2014/087933
§ 371 (c)(1),
(2) Date: May 20, 2015

(87) PCT Pub. No.: WO2015/180354
PCT Pub. Date: Dec. 3, 2015

(65) Prior Publication Data

US 2016/0300532 A1 Oct. 13, 2016

(30) Foreign Application Priority Data

May 26, 2014 (CN) ..... 2014 1 0226754

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/3233* (2013.01); *G09G 3/3291* (2013.01);
(Continued)

(58) Field of Classification Search
CPC ..... G09G 2300/043; G09G 2300/08; G09G 2300/0819; G09G 2300/0842;
(Continued)

(56) References Cited

U.S. PATENT DOCUMENTS

2002/0195968 A1* 12/2002 Sanford ..... G09G 3/325 315/169.3
2005/0017930 A1* 1/2005 Kobayashi ..... G09G 3/3208 345/76
(Continued)

FOREIGN PATENT DOCUMENTS

CN 1487486 A 4/2004
CN 1710637 A 12/2005
(Continued)

OTHER PUBLICATIONS

First Office Action regarding Chinese application No. 201410226754.9, dated Oct. 9, 2015. Translation provided by Dragon Intellectual Property Law Firm.
(Continued)

*Primary Examiner* — Roberto Flores
(74) *Attorney, Agent, or Firm* — Harness, Dickey & Pierce, P.L.C.

(57) ABSTRACT

The present disclosure provides a pixel circuit, a pixel circuit driving method and a display device. The pixel circuit includes a plurality of row pixel units. Each row pixel unit includes a plurality of subpixel units. Each of the subpixel units includes a subpixel driving circuit and a light-emitting component. Each row pixel unit further includes a row sharing unit. Each of the subpixel units is coupled with a first
(Continued)

signal line and a second signal line; the row sharing unit is coupled with each subpixel unit included in the row pixel unit through the first signal line and the second signal line, to have a threshold compensation function.

5 Claims, 3 Drawing Sheets

(51) Int. Cl.
*G09G 3/3291* (2016.01)
*G09G 3/3233* (2016.01)
*G09G 3/3266* (2016.01)

(52) U.S. Cl.
CPC ... *G09G 3/3266* (2013.01); *G09G 2300/0819* (2013.01); *G09G 2300/0842* (2013.01); *G09G 2300/0861* (2013.01); *G09G 2320/043* (2013.01)

(58) Field of Classification Search
CPC ..... G09G 2300/0866; G09G 3/3208–3/3291; G09G 2310/0243; G09G 2310/0248; G09G 2310/0251; G09G 2320/043
See application file for complete search history.

(56) References Cited

U.S. PATENT DOCUMENTS

2005/0218946 A1 10/2005 Miyazawa
2005/0243038 A1 11/2005 Kwak
2005/0280616 A1* 12/2005 Miwa ..... G09G 3/3233 345/77
2006/0221015 A1* 10/2006 Shirasaki ..... G09G 3/325 345/77
2007/0210994 A1* 9/2007 Chen ..... G09G 3/3233 345/76
2008/0036708 A1* 2/2008 Shirasaki ..... G09G 3/3233 345/76
2008/0111812 A1* 5/2008 Shirasaki ..... G09G 3/3233 345/212
2008/0246785 A1* 10/2008 Shirasaki ..... G09G 3/3233 345/690
2008/0252626 A1* 10/2008 Iida ..... G09G 3/3233 345/204
2009/0179831 A1* 7/2009 Yamashita ..... G09G 3/3233 345/76
2009/0207160 A1* 8/2009 Shirasaki ..... G09G 3/3233 345/212
2010/0001983 A1* 1/2010 Abe ..... G09G 3/3233 345/211
2010/0149152 A1* 6/2010 Yamamoto ..... G09G 3/3233 345/211
2010/0289787 A1* 11/2010 Omoto ..... G09G 3/3233 345/211
2012/0176426 A1* 7/2012 Ono ..... G09G 3/325 345/691
2012/0287102 A1* 11/2012 Toyomura ..... G09G 3/3233 345/211
2013/0009933 A1* 1/2013 Toyomura ..... G09G 3/3225 345/211
2013/0222356 A1* 8/2013 Jeong ..... G09G 3/3233 345/211
2014/0084805 A1* 3/2014 Kim ..... G09G 3/2048 315/228
2014/0339998 A1* 11/2014 Hsu ..... G09G 3/3233 315/291

FOREIGN PATENT DOCUMENTS

CN 101149901 A 3/2008
CN 101283391 A 10/2008
CN 102654975 A 9/2012
CN 202512329 U 10/2012
CN 103714778 A 4/2014
CN 104036724 A 9/2014
CN 203931451 U 11/2014
JP 2010038979 A 2/2010

OTHER PUBLICATIONS

Written Opinion of the International Searching Authority for international application No. PCT/CN2014/087933.

* cited by examiner

PIXEL CIRCUIT, PIXEL CIRCUIT DRIVING METHOD AND DISPLAY DEVICE

CROSS-REFERENCE TO RELATED APPLICATIONS

This application is the U.S. national phase of PCT Application No. PCT/CN2014/087933 filed on Sep. 30, 2014, which claims a priority of the Chinese Patent Application No. 201410226754.9 filed on May 26, 2014, the disclosures of which are incorporated in their entirety by reference herein.

The present application claims a priority of the Chinese patent application No. 201410226754.9 filed on May 26, 2014, which is incorporated herein by reference in its entirety.

TECHNICAL FIELD

The present disclosure relates to the field of display technology, in particular to a pixel circuit, a pixel circuit driving method and a display device.

BACKGROUND

A basic Active Matrix/Organic Light Emitting Diode (AMOLED) pixel driving circuit is a 2T1C pixel driving circuit which has a simple structure. In an AMOLED pixel driving circuit based on low temperature poly-silicon (LTPS), due to problems of LTPS such as non-uniform threshold voltages, a circuit for compensating for threshold voltages of driving thin film transistors (TFTs) is required to be added in pixel design for AMOLED. A typical AMOLED pixel driving circuit with compensation for threshold voltages requires a 6T1C pixel driving circuit or a 5T2C pixel driving circuit, or even more TFTs and/or capacitors. With increasing of the amount of the TFTs and/or capacitors, a larger layout space will be occupied, which makes it difficult to reduce size of AMOLED pixels, i.e., limiting development of the AMOLED pixel driving circuit with high pixel per inch (PPI).

SUMMARY

A main object of the present disclosure is to provide a pixel circuit, a pixel circuit driving method and a display device, which can improve an aperture ratio of pixels and reduce a current density in an organic light-emitting layer in addition to obtaining uniform display.

In order to achieve the above object, the present disclosure provides a pixel circuit including a plurality of row pixel units; each row pixel unit including a plurality of subpixel units; wherein each of the subpixel units includes a subpixel driving circuit and a light-emitting component; the subpixel driving circuit includes a driving transistor coupled with the light-emitting component, and a driving control module which is coupled with a data line and the driving transistor, respectively; each row pixel unit further includes a row sharing unit;

each of the subpixel units is coupled with a first signal line and a second signal line; and the row sharing unit is coupled with each subpixel unit included in the row pixel unit through the first signal line and the second signal line, to have a threshold compensation function.

Alternatively, the subpixel units are arranged in an effective display area; and the row sharing unit is arranged outside the effective display area.

Alternatively, the driving transistor has a first electrode coupled with a first terminal of the light-emitting component, and a second electrode coupled with the first signal line; a second terminal of the light-emitting component is coupled with the second signal line;

the driving control module is coupled with a gate electrode, the first electrode and the second electrode of the driving transistor, respectively;

the driving control module is further coupled with a scanning line;

the row sharing unit includes an initialization module for receiving an initial control signal, and a light-emitting control module for receiving a light-emitting control signal;

the initialization module is coupled with the first signal line, and is configured to, when the initial control signal and a scanning signal in the scanning line are valid at the same time, set a gate potential of the driving transistor to be equal to an initial level through the driving control module;

the light-emitting control module is configured to, when the light-emitting control signal is valid, control the first signal to receive a first level and enable the second signal line to receive a second level;

the driving control module is configured to, when the scanning signal is valid, control to write a data voltage from the data line into the driving transistor; when the light-emitting control signal is valid, control the driving transistor to drive the light-emitting component to emit light and compensate for a threshold of the driving transistor.

Alternatively, the driving control module includes a data writing transistor, a driving control transistor and a storage capacitor;

the data writing transistor has a gate electrode coupled with the scanning line, a first electrode coupled with the data line, and a second electrode coupled with the first electrode of the driving transistor;

the driving control transistor has a gate electrode coupled with the scanning line, a first electrode coupled with the gate electrode of the driving transistor, and a second electrode coupled with the second electrode of the driving transistor;

the storage capacitor has a first terminal coupled with the first electrode of the driving transistor, and a second terminal coupled with the gate electrode of the driving transistor.

Alternatively, the initialization module includes an initialization transistor; the initialization transistor has a gate electrode for receiving the initial control signal, a first electrode coupled with the first signal line, and a second electrode for receiving the initial level.

Alternatively, the light-emitting control module includes:

a first light-emitting control transistor having a gate electrode for receiving the light-emitting control signal, a first electrode for receiving the first level, and a second electrode coupled with the first signal line;

a second light-emitting control transistor having a gate electrode for receiving the light-emitting control signal, a first electrode coupled with the second signal line, and a second electrode for receiving the second level.

The present disclosure further provides a pixel circuit driving method, which is applied to the above pixel circuit, the pixel circuit driving method including:

a initialization step: turning on a driving control transistor, writing a data voltage into a first electrode of a driving transistor, and setting, by an initialization module, a gate potential of the driving transistor to be equal to an initial level through the driving control transistor, in an initialization stage, wherein an initial control signal and a scanning signal in a scanning line are valid at the same time;

a compensation step: turning on a data writing transistor and the driving control transistor, writing data voltage into the first electrode of the driving transistor, and discharging the gate potential of the driving transistor through a storage capacitor so as to compensate for a threshold voltage of the driving transistor, in a compensation stage, wherein the scanning signal is valid; and a light-emitting step: receiving, by a first signal line, a first level, receiving, by a second signal line, a second level, turning off the driving control transistor to control a second terminal of the storage capacitor to be floated so as to maintain the gate potential of the driving transistor unchanged, and turning on the driving transistor to drive a light-emitting component to emit light, in a light-emitting stage, wherein a light-emitting control signal is valid.

The present disclosure further provides a display device including the above pixel circuit.

Comparing with the related art, the pixel circuit according to one embodiment of the present disclosure adopts the row sharing units, so that thresholds of the driving transistors may be compensated and at the same time an amount of TFTs in an effective display area may be reduced so as to improve an aperture ratio of pixels. As a result, the display is uniform, and a current density in an organic light-emitting layer is reduced, thereby extending the service life of an AMOLED panel.

DETAILED DESCRIPTION

Figure 1:
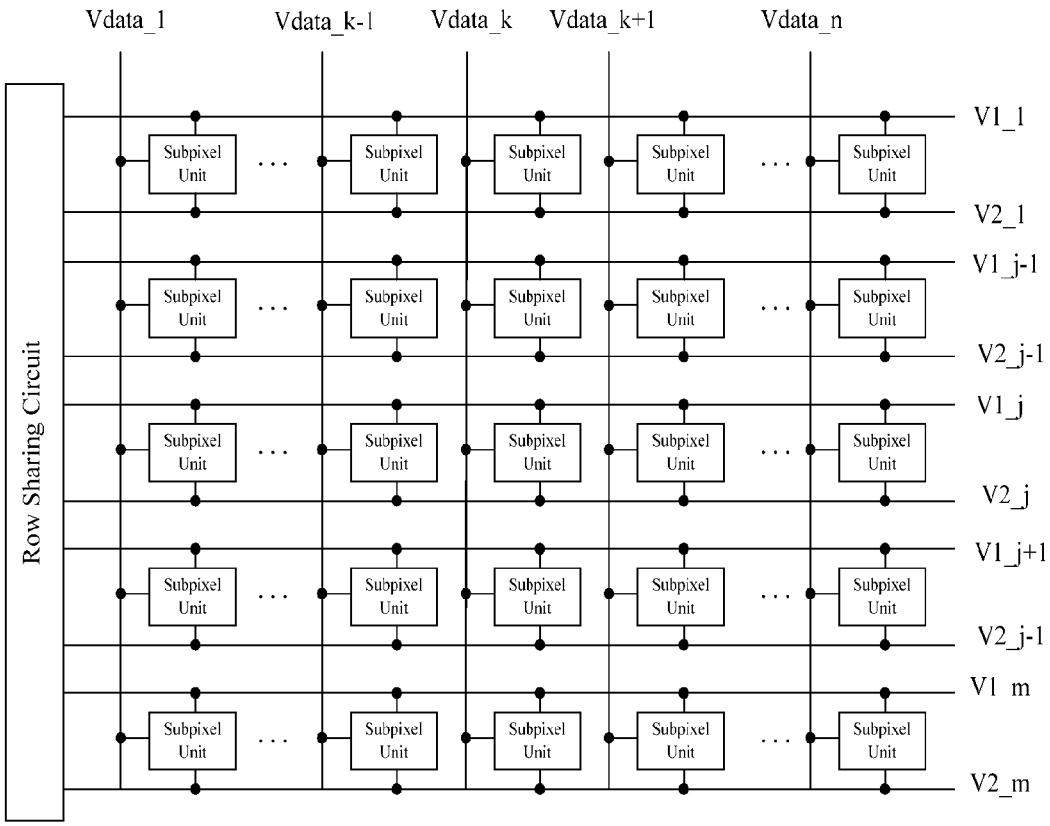
FIG. 1 is a diagram of a pixel circuit according to one embodiment of the present disclosure.

The technical solutions of embodiments of the present disclosure will be described hereinafter in a clear and complete manner in conjunction with drawings of the embodiments of the present disclosure. Obviously, the described embodiments are merely some rather than all of, the embodiments of the present disclosure. Based on these embodiments of the present disclosure, a person skilled in the art may obtain other embodiments without creative work, which also fall within the scope of the present disclosure.

Transistors adopted in all embodiments of the present disclosure may be thin film transistors, field effect transistors, or other devices having same characteristics. In embodiments of the present disclosure, in order to distinguish two electrodes of a transistor in addition to a gate electrode, a first electrode of the two may be referred to as "source electrode" or "drain electrode", and a second electrode of the two may be referred to as "drain electrode" or "source electrode". In addition, transistors may be divided into n-type transistors and p-type transistors according to characteristics of the transistors. In a driving circuit provided in one embodiment of the present disclosure, all transistors being n-type transistors is taken as an example for illustration, it can be conceivable that a person skilled in the art easily thinks of using p-type transistors without creative work, which also fall within the scope of the present disclosure.

A pixel circuit according to one embodiment of the present disclosure includes a plurality of row pixel units. Each row pixel unit includes a plurality of subpixel units. Each of the subpixel units includes a subpixel driving circuit and a light-emitting component. The subpixel driving circuit includes a driving transistor coupled with the light-emitting component, and a driving control module which is coupled with a data line and the driving transistor, respectively. Each row pixel unit further includes a row sharing unit. Each of the subpixel units is coupled with a first signal line and a second signal line. The row sharing unit is coupled with each subpixel unit included in the row pixel unit through the first signal line and the second signal line, thereby having a threshold compensation function.

In the pixel circuit according to one embodiment of the present disclosure, in addition to the subpixel driving circuit, the subpixel unit further includes the light-emitting component. The subpixel driving circuit and the light-emitting component together form the subpixel unit. The light-emitting component, for example, may be an organic light-emitting diode (OLED).

The pixel circuit according to one embodiment of the present disclosure adopts the row sharing units, so that thresholds of driving transistors may be compensated while an amount of TFTs in an effective display area may be reduced so as to improve an aperture ratio of pixels. As a result, the display is uniform, and a current density in an organic light-emitting layer is reduced, thereby extending the service life of an AMOLED panel.

Alternatively, the subpixel units are arranged in the effective display area, and the row sharing units are arranged outside the effective display area. By arranging a circuit having general character in each row pixel unit outside the effective display area, the amount of TFTs in the effective display area may be further reduced so as to improve the aperture ratio of pixels.

Specifically, the pixel circuit of one embodiment of the present disclosure includes m row pixel units; each row pixel unit includes n subpixel units; all of the n subpixel units included in a j-th row pixel unit are coupled with a j-th scanning line (not shown in FIG. 1); a k-th subpixel unit included in each row pixel unit is coupled with a k-th data line; where either of m and n is an integer greater than 1; j is a positive integer which is less than or equal to m; k is a positive integer which is less than or equal to n.

As shown in FIG. 1, Vdata_1 is a data voltage output from a first data line; Vdata_k−1 is a data voltage output from a (k−1)-th data line; Vdata_k is a data voltage output from a k-th data line; Vdata_k+1 is a data voltage output from a (K+1)-th data line; Vdata_n is a data voltage output from an n-th data line.

Each of the subpixel units includes a subpixel driving circuit and a light-emitting component. The subpixel driving circuit includes a driving transistor coupled with the light-emitting component, and a driving control module which is coupled with a data line and the driving transistor, respectively.

Each row pixel unit further includes a row sharing unit; m row sharing units form a row sharing circuit.

Each of the subpixel units included in each row pixel circuit is coupled with a first signal line and a second signal line.

The row sharing unit is coupled with each subpixel unit included in each row pixel unit through the first signal line and the second signal line, thereby having a threshold compensation function.

The subpixel units are arranged in an effective display area, and the row sharing unit is arranged outside the effective display area.

In FIG. 1, V1_1 is a first signal line for a first row pixel circuit, V2_1 is a second signal line for the first row pixel circuit; V1_*j*−1 is a first signal line for a (j−1)-th row pixel circuit, V2_*j*−1 is a second signal line for the (j−1)-th row pixel circuit; V1_*j* is a first signal line for a j-th row pixel circuit, V2_*j* is a second signal line for the j-th row pixel circuit; V1_*j*+1 is a first signal line for a (j+1)-th row pixel circuit, V2_*j*+1 is a second signal line for the (j+1)-th row pixel circuit; V1_*m* is a first signal line for an m-th row pixel circuit, V2_*m* is a second signal line for the m-th row pixel circuit.

Optionally, the driving transistor has a first electrode coupled with a first terminal of the light-emitting component, and a second electrode coupled with the first signal line. A second terminal of the light-emitting component is coupled with the second signal line.

The driving control module is coupled with a gate electrode, the first electrode and the second electrode of the driving transistor, respectively.

The driving control module is further coupled with a scanning line.

The row sharing unit includes an initialization module for receiving an initial control signal, and a light-emitting control module for receiving a light-emitting control signal.

The initialization module is coupled with the first signal line, and is configured to, when the initial control signal and a scanning signal in the scanning line are valid at the same time, set a gate potential of the driving transistor to be equal to an initial level through the driving control module.

The light-emitting control module is configured to, when the light-emitting control signal is valid, control the first signal line to receive a first level and enable the second signal line to receive a second level.

The driving control module is configured to, when the scanning signal is valid, control to write a data voltage from the data line into the driving transistor; when the light-emitting control signal is valid, control the driving transistor to drive the light-emitting component to emit light and compensate for a threshold of the driving transistor.

Optionally, the driving control module includes a data writing transistor, a driving control transistor and a storage capacitor.

The data writing transistor has a gate electrode coupled with the scanning line, a first electrode coupled with the data line, and a second electrode coupled with the first electrode of the driving transistor.

The driving control transistor has a gate electrode coupled with the scanning line, a first electrode coupled with the gate electrode of the driving transistor, and a second electrode coupled with the second electrode of the driving transistor.

The storage capacitor has a first terminal coupled with the first electrode of the driving transistor, and a second terminal coupled with the gate electrode of the driving transistor.

Optionally, the initialization module includes an initialization transistor. The initialization transistor has a gate electrode for receiving the initial control signal, a first electrode coupled with the first signal line, and a second electrode for receiving the initial level.

Optionally, the light-emitting control module includes:

a first light-emitting control transistor having a gate electrode for receiving the light-emitting control signal, a first electrode for receiving the first level, and a second electrode coupled with the first signal line;

a second light-emitting control transistor having a gate electrode for receiving the light-emitting control signal, a first electrode coupled with the second signal line, and a second electrode for receiving the second level.

Specifically, connections between one subpixel unit and one row sharing unit are taken as an example for illustration in the following.

Figure 2:
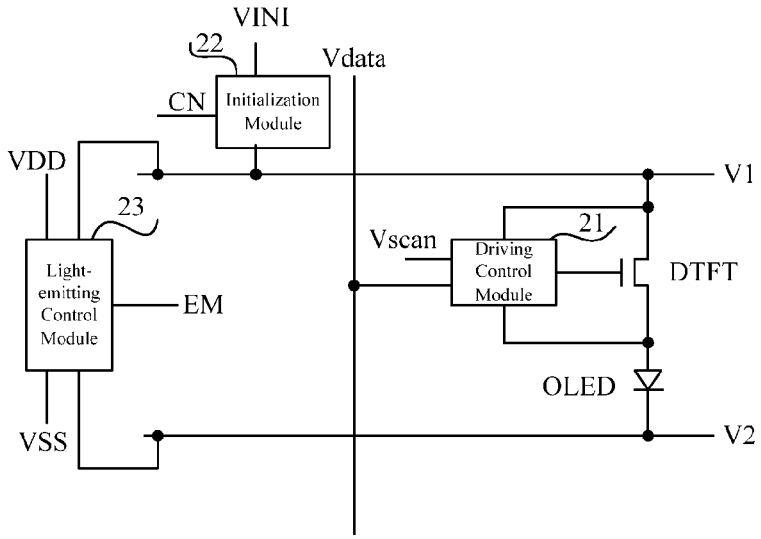
FIG. 2 is a block diagram of a subpixel unit and a row sharing unit included in the pixel circuit according to one embodiment of the present disclosure.

As shown in FIG. 2, the subpixel unit includes a subpixel driving circuit and an organic light-emitting diode (OLED). The subpixel driving circuit includes a driving transistor DTFT coupled with the OLED, and a driving control module 21 which is coupled with a data line Data, a gate electrode of the driving transistor DTFT, a first electrode of the driving transistor DTFT and a second electrode of the driving transistor DTFT, respectively.

The first electrode of the driving transistor DTFT is coupled with an anode electrode of the OLED; the second electrode of the driving transistor DTFT is coupled with a first signal line V1.

A cathode electrode of the OLED is coupled with a second signal line V2.

The driving control module 21 further receives a scanning signal Vscan from a scanning line.

The row sharing unit includes an initialization module 22 for receiving an initial control signal CN, and a light-emitting control module 23 for receiving a light-emitting control signal EM.

The initialization module 22 is coupled with the first signal line V1, and is configured to, when the initial control signal CN and the scanning signal Vscan in the scanning line are valid at the same time, set a gate potential of the driving transistor DTFT to be equal to an initial level VINI through the driving control module 21.

The light-emitting control module 23 is configured to, when the light-emitting control signal EM is valid, control the first signal V1 to receive a high level VDD and enable the second signal line V2 to receive a low level VSS. That is, the first level is the high level VDD, and the second level is the low level VSS.

The driving control module 21 is configured to, when the scanning signal Vscan is valid, control to write a data voltage Vdata from the data line into the driving transistor DTFT; and when the light-emitting control signal EM is valid, control the driving transistor DTFT to drive the OLED to emit light and compensate for the threshold of the driving transistor DTFT.

Figure 3:
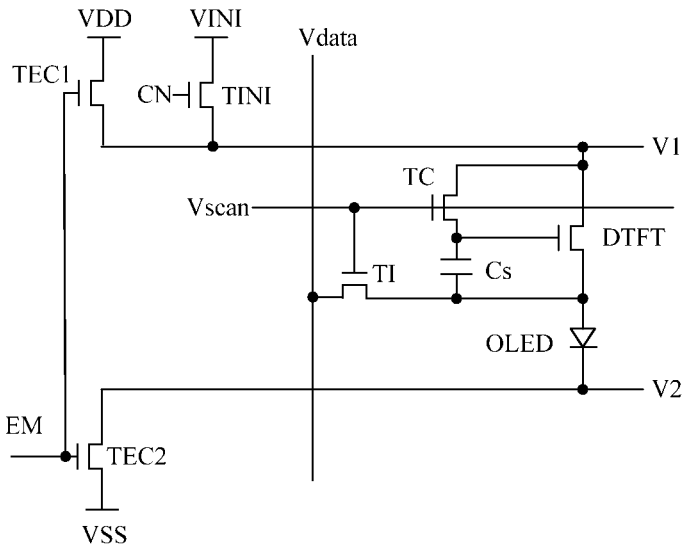
FIG. 3 is a circuit diagram of a subpixel unit and a row sharing unit included in the pixel circuit according to one embodiment of the present disclosure.

Specifically, as shown in FIG. 3, the driving control module may include a data writing transistor TI, a driving control transistor TC and a storage capacitor Cs.

The data writing transistor TI has a gate electrode for receiving the scanning signal Vscan, a first electrode for receiving the data voltage Vdata from the data line, and a second electrode coupled with the first electrode of the driving transistor DTFT.

The driving control transistor TC has a gate electrode for receiving the scanning signal Vscan, a first electrode coupled with the gate electrode of the driving transistor DTFT, and a second electrode coupled with the second electrode of the driving transistor DTFT.

The storage capacitor Cs has a first terminal coupled with the first electrode of the driving transistor DTFT, and a second terminal coupled with the gate electrode of the driving transistor DTFT.

The initialization module includes an initialization transistor TINI. The initialization transistor TINI has a gate electrode for receiving the initial control signal CN, a first electrode coupled with the first signal line V1, and a second electrode for receiving the initial level *VINI*.

The light-emitting control module includes:

a first light-emitting control transistor TEC1 having a gate electrode for receiving the light-emitting control signal EM, a first electrode for receiving the high level VDD, and a second electrode coupled with the first signal line V1;

a second light-emitting control transistor TEC2 having a gate electrode for receiving the light-emitting control signal EM, a first electrode coupled with the second signal line V2, and a second electrode for receiving the low level VSS.

Each of DTFT, TI, TC, TINT, TEC1 and TEC2 is an n-type TFT.

In the embodiment shown in FIG. 3, the subpixel unit including DTFT, TI, TC, Cs and OLED is arranged in an effective display area; the row sharing unit including TEC1, TEC2 and TINT is arranged outside the effective display area. In each identical row pixel unit, the plurality of subpixel units are coupled with the row sharing unit, thereby having a threshold compensation function.

In actual implementation, it is not limited to the above embodiments, it is merely required to adopt the row sharing units to achieve the purpose of reducing the TFTs in the effective display area, thereby reducing size of pixels.

Figure 4:
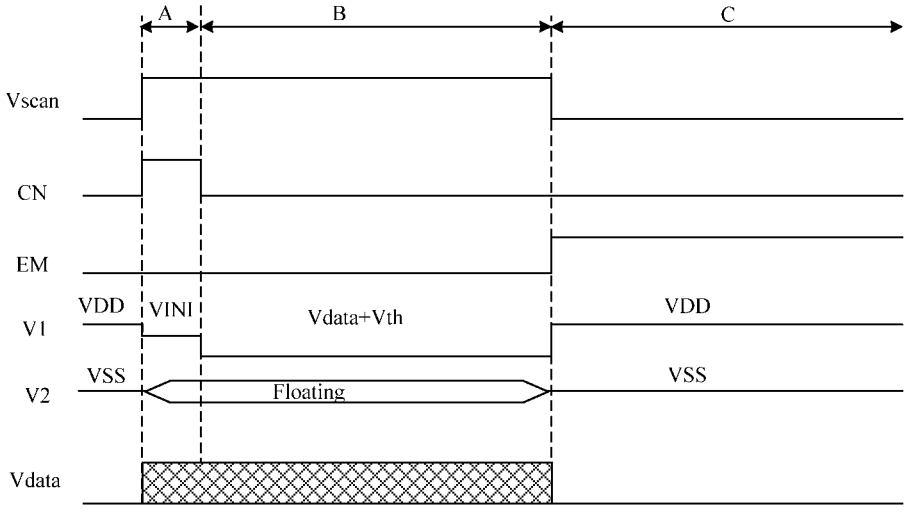
FIG. 4 is a working timing sequence diagram of the pixel circuit including the subpixel unit and the row sharing unit as shown in FIG. 3.

An operation timing sequence of the embodiment shown in FIG. 3 is shown in FIG. 4 (in which, Vdata is a data voltage, and represents information of images, and is relative to an image to be displayed; when the image is uncertain, data is then uncertain; thus, an output level of Vdata is illustrated by grip-like fill), and may be divided into three stages.

Stage A (initialization stage): Vscan and CN are at high levels, EM is at a low level, TI, TC and TIN1 are turned on, TEC1 and TEC2 are turned off, Vdata is written in through TI, a voltage at V1 is VINI, a voltage at V2 is a floating voltage, a drain electrode (second electrode) of DTFT is coupled with the gate electrode of DTFT, a gate potential of DTFT is equal to an initial level VINI, and a potential of a source electrode (first electrode) of DTFT is Vdata.

Stage B (compensation stage): Vscan is at a high level, CN and EM are at low levels, TI and TC are turned on, TINI, TEC1 and TEC2 are turned off, the drain electrode (second electrode) of DTFT is coupled with the gate electrode of DTFT, the source electrode (first electrode) of DTFT receives Vdata, a diode connection is formed on DTFT, the gate potential of DTFT is discharged from the initial level VINI to Vdata+Vth (Vth is the threshold of DTFT), i.e., a potential of a second terminal of Cs is Vdata+Vth; at this time, the voltage at V1 is Vdata+Vth, the voltage at V2 is a floating voltage.

Stage C (light-emitting stage): Vscan and CN are at low levels, EM is at a high level, i.e., TI, TC and TINI are turned off, TEC1 and TEC2 are turned on, the voltage at V1 is changed to be at a high level VDD, the voltage at V2 is changed from the floating voltage to be at a low level VSS, the gate potential of DTFT is maintained by the storage capacitor Cs to be Vdata+Vth (at this time, since the second terminal of Cs is floated, thus a discharge path of Cs is shut off; therefore, the potential at the second terminal of Cs, i.e., the gate potential of DTFT is maintained by Cs); at this time, the potential at the source electrode (first electrode) of DTFT is VSS, thus a drain current flowing though DTFT $I_{DS}=K\times(Vdata+Vth-VSS-Vth)^2=K\times(Vdata-VSS)^2$, where K is a constant related to process and design, then, finally, a current for driving OLED is unrelated to the threshold voltage of DTFT, and only related to Vdata.

Figure 5:
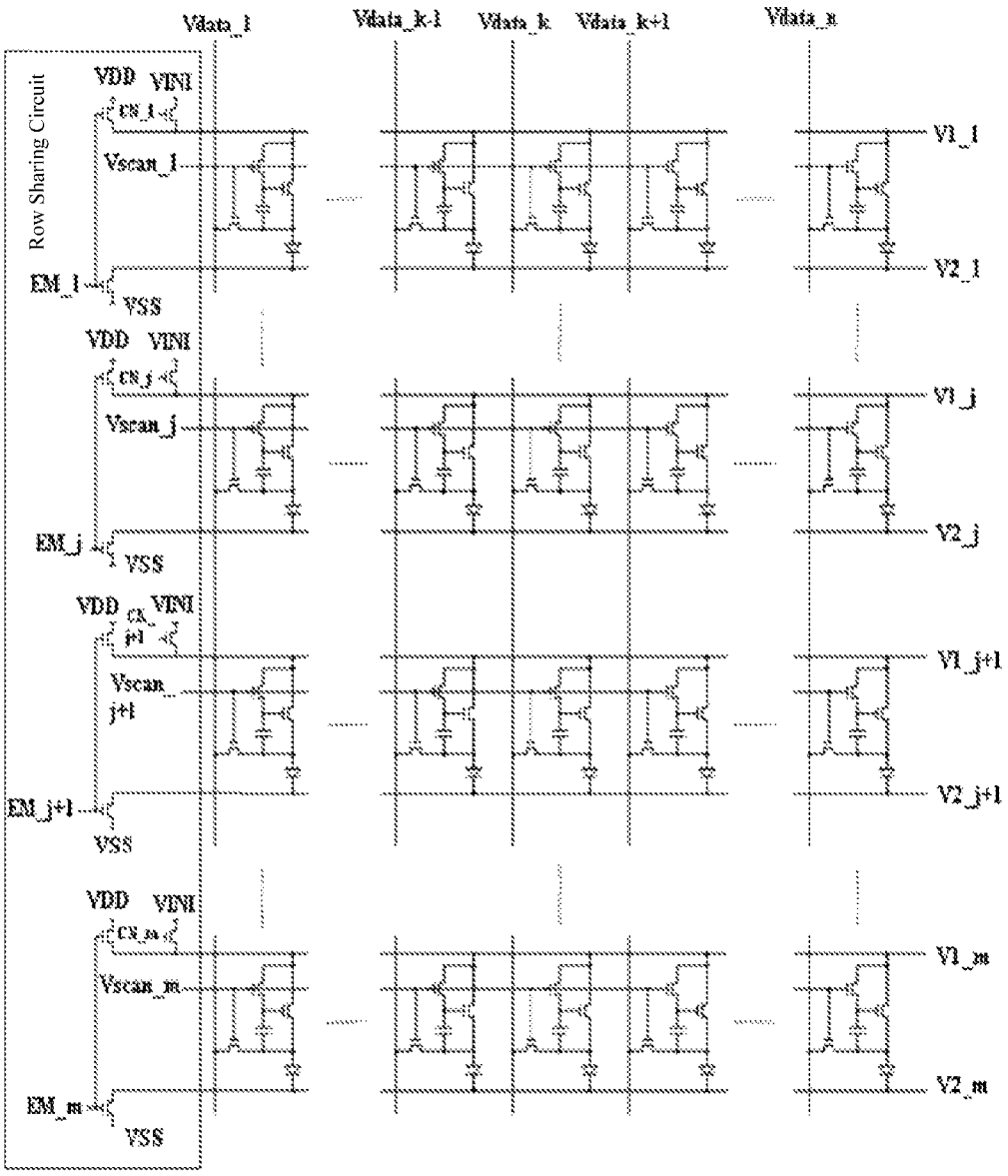
FIG. 5 is a circuit diagram of the pixel circuit according to one embodiment of the present disclosure.

FIG. 5 is a circuit diagram of the pixel circuit which adopts the subpixel unit and the row sharing unit shown in FIG. 3. As can be seen from FIG. 5, each row pixel unit shares the row sharing unit on the left side. M row sharing units form a row sharing circuit. For the row sharing unit for a first row pixel circuit, an initial control signal is CN_1, a scanning signal is Vscan_1, and a light-emitting control signal is EM_1; for the row sharing unit for a j-th row pixel circuit, an initial control signal is CN_j, a scanning signal is Vscan_j, and a light-emitting control signal is EM_j; for the row sharing unit for a (j+1)-th row pixel circuit, an initial control signal is CN_j+1, a scanning signal is Vscan_j+1, and a light-emitting control signal is EM_j+1; for the row sharing unit for an m-th row pixel circuit, an initial control signal is CN_m, a scanning signal is Vscan_m, and a light-emitting control signal is EM_m; j is a positive integer which is less than or equal to m.

The present disclosure further provides a pixel circuit driving method, applied to the above pixel circuit, the pixel circuit driving method includes:

a initialization step: in the initialization stage, an initial control signal and a scanning signal in a scanning line are valid at the same time, a driving control transistor is turned on, a data voltage Vdata is written into a first electrode of a driving transistor, an initialization module sets a gate potential of the driving transistor to be equal to an initial level VINI through the driving control transistor;

a compensation step: in the compensation stage, the scanning signal is valid, a data writing transistor and the driving control transistor are turned on, data voltage is written into the first electrode of the driving transistor, the gate potential of the driving transistor is discharged through a storage capacitor to Vdata+Vth, so as to compensate for a threshold voltage of the driving transistor, where Vth represents the threshold voltage of the driving transistor; and a light-emitting step: in the light-emitting stage, a light-emitting control signal is valid, a first signal line receives a first level, a second signal line receives a second level, the driving control transistor is turned off to control a second terminal of the storage capacitor to be floated, so as to maintain the gate potential of the driving transistor unchanged, the driving transistor is turned on to drive the light-emitting component to emit light.

A display device according to one embodiment of the present disclosure includes the above pixel circuit. The display device may include a liquid crystal display device, such as a liquid crystal panel, a liquid crystal TV, a mobile phone, a liquid crystal monitor. In addition to the liquid crystal display device, the display device may also include an organic light-emitting display or other kinds of display devices, such as e-readers.

The above descriptions are merely intended to illustrate but not limit the present disclosure. It should be appreciated that, a person skilled in the art may make further modifications, variations or equivalent arrangements without departing from the spirit and scope defined by appended claims. Therefore, all the modifications, variations or equivalent arrangements may fall within the scope of the present disclosure.

What is claimed is:

1. A pixel circuit comprising:

a plurality of row pixel units, each row pixel unit comprising a plurality of subpixel units, wherein each of the subpixel units comprises a subpixel driving circuit and a light-emitting component, the subpixel driving circuit comprises a driving transistor coupled with the light-emitting component and a driving control module that is coupled with a data line and the driving transistor, respectively;

each row pixel unit further comprising a row sharing unit;

each of the subpixel units coupled with a first signal line and a second signal line; and the row sharing unit coupled with each subpixel unit included in the row pixel unit through the first signal line and the second signal line to have a threshold compensation function, wherein the driving transistor has a first electrode coupled with a first terminal of the light-emitting component and a second electrode coupled with the first signal line; a second terminal of the light-emitting component coupled with the second signal line; the driving control module coupled with a gate electrode, the first electrode, and the second electrode of the driving transistor, respectively; the driving control module is further coupled with a scanning line; the row sharing unit comprises an initialization module for receiving an initial control signal and a light-emitting control module for receiving a light-emitting control signal; the initialization module coupled with the first signal line and is configured to, when the initial control signal and a scanning signal in the scanning line are valid at the same time, set a gate potential of the driving transistor to be equal to an initial level through the driving control module; the light-emitting control module is configured to, when the light-emitting control signal is valid, control the first signal line to receive a first level and enable the second signal line to receive a second level; and the driving control module is configured to, when the scanning signal is valid, control to write a data voltage from the data line into the driving transistor, and, when the light-emitting control signal is valid, control the driving transistor to drive the light-emitting component to emit light and compensate for a threshold of the driving transistor, wherein the driving control module comprises a data writing transistor, a driving control transistor, and a storage capacitor; the data writing transistor including a gate electrode coupled with the scanning line, a first electrode coupled with the data line, and a second electrode coupled with the first electrode of the driving transistor; the driving control transistor including a gate electrode coupled with the scanning line, a first electrode coupled with the gate electrode of the driving transistor, and a second electrode coupled with the second electrode of the driving transistor; and the storage capacitor including a first terminal coupled with the first electrode of the driving transistor, and a second terminal coupled with the gate electrode of the driving transistor, the initialization module comprises an initialization transistor; the initialization transistor including a gate electrode for receiving the initial control signal, a first electrode coupled with the first signal line, and a second electrode for receiving the initial level, the light-emitting control module comprises:

a first light-emitting control transistor including a gate electrode for receiving the light-emitting control signal, a first electrode for receiving the first level, and a second electrode coupled with the first signal line;

a second light-emitting control transistor including a gate electrode for receiving the light-emitting control signal, a first electrode coupled with the second signal line, and a second electrode for receiving the second level, wherein the first signal line of a respective row pixel unit receives the first level through the first light-emitting control transistor and the second signal line of the respective row pixel unit receives the second level through the second light-emitting control transistor when the same light-emitting control signal is applied to the gate electrode of the first light-emitting control transistor and the gate electrode of the second light-emitting control transistor.

2. The pixel circuit according to claim 1, wherein the subpixel units are arranged in an effective display area; and the row sharing unit is arranged outside the effective display area.

3. A pixel circuit driving method, which is applied to the pixel circuit according to claim 1, the pixel circuit driving method comprising:

turning on a driving control transistor, writing a data voltage into a first electrode of a driving transistor, and setting, by an initialization module, a gate potential of the driving transistor equal to an initial level through the driving control transistor, in an initialization stage, wherein an initial control signal and a scanning signal in a scanning line are valid at the same time;

turning on a data writing transistor and the driving control transistor, writing data voltage to the first electrode of the driving transistor, and discharging the gate potential of the driving transistor through a storage capacitor to compensate for a threshold voltage of the driving transistor, in a compensation stage, wherein the scanning signal is valid; and receiving, by a first signal line, a first level; receiving, by a second signal line, a second level, turning off the driving control transistor to control a second terminal of the storage capacitor to be floated to maintain the gate potential of the driving transistor unchanged, and turning on the driving transistor to drive a light-emitting component to emit light, in a light-emitting stage, wherein a light-emitting control signal is valid.

4. A display device comprising the pixel circuit according to claim 1.

5. The display device according to claim 4, wherein the subpixel units are arranged in an effective display area; and the row sharing unit is arranged outside the effective display area.

* * * * *